US005502870A

United States Patent [19]

Ragner et al.

[11] Patent Number: 5,502,870

[45] Date of Patent: Apr. 2, 1996

[54] FIVE-FUNCTION VACUUM CLEANER NOZZLE

[76] Inventors: Gary D. Ragner, 3111 SW. 34th St. Lot #70, Gainesville, Fla. 32608; Robert de Rochmont, Jr., 1014 NE. 3rd St., Gainesville, Fla. 32601

[21] Appl. No.: 168,879

[22] Filed: Dec. 16, 1993

[51] Int. Cl.[6] ..... A47L 9/02

[52] U.S. Cl. ..... 15/393; 15/398; 15/417

[58] Field of Search ..... 15/398, 399, 400, 15/416, 417, 393

[56] References Cited

U.S. PATENT DOCUMENTS

| | | | |
|---|---|---|---|
| 2,815,525 | 12/1957 | Lofgren | 15/417 |
| 2,960,716 | 11/1960 | Kemnitz | 15/417 |
| 3,108,311 | 10/1963 | House | 15/417 |
| 4,459,720 | 7/1984 | Ahlf et al. | 15/398 |
| 4,506,406 | 3/1985 | LaMonte | 15/398 |
| 4,688,294 | 8/1987 | Simonsson | 15/417 X |
| 4,694,529 | 9/1987 | Choiniere | 15/393 |
| 4,897,894 | 2/1990 | Fahlën | 15/417 X |

*Primary Examiner*—Chris K. Moore

[57] ABSTRACT

A multi-function vacuum cleaner nozzle for attachment to the end of a vacuum cleaner hose. The device comprises a housing body (40), a dust brush (44), and two pivotal cleaning arms (6). Housing (40) has three ports (50), (52), and (54) extending therethrough, with port (50) and port (52) being adapted to receive a suction conduit (4). Port (52) is fitted with dust brush (44) which snaps into a recess (42) encircling said housing. Insertion of the conduit into port (52) selects the arms to receive suction air and substantially doses off port (50). Arms (6) are attached on the end of port (54) which is opposite port (52). Friction ridges (28) and (74) interact with each other, allowing several stable positions for arms (6). This makes the arms adjustable between upholstery, crevice, edge and corner tool positions. Insertion of said conduit into port (50) selects said dust brush to receive suction air and substantially closes off port (54).

18 Claims, 7 Drawing Sheets

FIVE-FUNCTION VACUUM CLEANER NOZZLE

BACKGROUND

DESCRIPTION OF PRIOR ART

Innovation has always been the way to promote more efficient living. Inventions such as electric appliances, and microwave ovens have made our lives easier; Computers and facsimile machines have saved us time. Everywhere we turn technology has made our lives better.

The disclosed invention follows in these historic footsteps, and makes everyday life simpler. This invention makes the process of cleaning ones home more enjoyable.

The design of home vacuum cleaners have not changed much in the last 70 years. Some of the original designs, like the Royal Upright, have not changed much since the 1920's, and still outperforms many of the newer models.

Recently however, a major change has taken place in the vacuum cleaner market. The incorporation a vacuum hose along with an upright vacuum cleaner has spread throughout the market. This is no surprise since having a hose and its attachments at hand allows the user to easily switch from one mode of cleaning to another. No longer does one have to attach a clumsy cover over the beater bar opening to attach a hose.

This switch to multipurpose vacuum cleaners, however, has seen very little redesign of the nozzle attachments. The crevice, upholstery, and dust brush nozzles have not changed much since they were invented. A crevice tool is still a long narrow tube for getting into small openings like the space between seat cushions, while an upholstery tool is still designed with a long rectangular nozzle for cleaning a fabric surface quickly. And a brush tool is still a ring of bristles around a vacuum port for cleaning dust off of hard surfaces without scratching. These three tools have been the mainstay of the vacuum cleaner industry for decades. Only recently have people begun to combine these tools.

U.S. Pat. No. 4,688,294 to Simonsson on Aug. 25, 1987 shows a vacuum nozzle with two functions: a brush tool and an upholstery tool. The design is basically comprised of two separate tools which have been joined together. Each tool has its own nozzle port and its own cleaning duct.

U.S. Pat. No. 2,815,525 to Lofgren on Dec. 10, 1957, U.S. Pat. No. 3,108,311 to House on Oct. 29, 1963, and U.S. Pat. No. 4,897,894 to Fahlen on Feb. 6, 1990, combines a dust brush with an upholstery tool like Simonsson's device, but uses a single air passageway for both tools. With the use of folding arms these three devices convert the upholstery tool into a nozzle inlet. This arrangement saves space, and makes the tool very compact. Unfortunately, none of these tools have a way to clean sharp corners, edges, or crevices. One must use other nozzles to perform these cleaning tasks, a significant disadvantage.

Other devices such as, U.S. Pat. No. 4,459,720 to Ahlf on Jul. 17, 1984, U.S. Pat. No. 4,506,406 to LaMonte on Mar. 26, 1985, and U.S. Pat. No. 4,694,529 to Choiniere on Sep. 22, 1987 combine different forms of crevice and upholstery tools. Choiniere's device does not even bother to seal one tool from the other, both are open to the same air flow. This two opening tool configuration reduces the effectiveness of both tools, making it practically useless except in very specific tasks. Ahlf's device is basically two tools joined together, each with its own air duct. The design has the aspiration of each tool selectively by actuating the suction hose respective to the nozzle. This feature makes it easier to use, but requires a valve flap and a flexible joint. Both of which make the tool more prone to failure and complicated. LaMonte's tool solves half the air direction problem with a sliding door, but the side mounted upholstery tool is extremely awkward for most items.

Our five-function vacuum cleaner nozzle provides a simple and highly functional tool that combines all 3 of the major vacuum nozzle tools, plus an added advantage of being convertible into a corner tool and an edge tool. No other vacuum cleaner nozzle combines so many functions. The user may clean upholstery, or crevices, or edges, or stair corners, or hard surfaces without having to returning to the vacuum cleaner to change tools. The problem of running back and forth to the vacuum cleaner has been solved.

Our vacuum nozzle has the added advantage of being extremely compact. It has the same number of parts and is approximately the same size and shape as Fahlen's invention, (a commercially successful two-function tool). The small size of our vacuum nozzle seems to defy the incredible increase in functionality over Fahlen's invention. Our five-function vacuum nozzle is compact enough to be placed right on the handle of the vacuum hose for immediate use.

OBJECTIVES AND ADVANTAGES

Accordingly, several objects and advantages of our invention are:

a) The integration of 5 separate vacuum cleaner nozzles into a single compact unit.

b) The use of a single air passageway for all five tool functions.

c) All 5 tools are scaled off from each other when in operation.

d) Tool has a convenient bend in it so that it is easy for the tool to be angled against a surface.

e) Requires less plastic than would be needed to make five separate nozzle tools, thus saving resources.

f) Tool arms can be angled between zero and 180 degree for cleaning corners, such as the lip on carpeted stairs.

g) Tool has openings at the ends of the upholstery tool, creating a high speed air flow, for better cleaning.

i) The openings on the ends of the arms while in upholstery configuration not only provide better air flow for picking up dirt, but also produce an edge cleaning effect.

j) And, because all five tools are in one, they take up less space. This allows for a smaller, more compact, vacuum cleaner design. The space savings could be used to allow other cleaning equipment to be placed on the vacuum. Possible accessories could include, a dust cloth, spray bottle, extra bags for the vacuum cleaner, and etc.

k) Finally, the dust brush is removable and can be replaced with any number of other tools. To do floors one could attach a floor brush. Or if a very long crevice tool is needed, it could be attached. These nozzle attachable tools further extends the functionality of this tool.

DRAWING FIGURES

FIG. 1 Section view of the Four-function nozzle in corner tool position with phantom lines showing some possible arm positions.

FIG. 2 Side view of the Four-function nozzle in section.

FIG. 3 Perspective view of Four-function nozzle.

FIG. 4 Detailed view of Pivotal Cleaning Arms.

FIG. 5A Section view of the Five-function nozzle in Dust-Brush configuration.

FIG. 5B Section view of the Five-function nozzle with a floor brush attachment installed.

FIG. 6 Front section view of the Five,function nozzle in Corner tool configuration.

FIG. 7 Section view of the Five-function nozzle in Crevice tool configuration.

FIG. 8 Perspective view of the Five-function nozzle in Upholster/Edge configuration, with crevice tool configuration shown in phantom lines.

FIG. 9A Section view of alternative Five-function nozzle.

FIG. 9B Alternate five-function nozzle in crevice/upholstery configuration.

FIG. 10 Perspective view of alternative Five-function nozzle Arm.

FIG. 11 Side view of alternative Five-function nozzle in section.

DRAWING REFERENCE NUMBERS

| | |
|---|---|
| 2 Nozzle housing (4-function) | 4 Suction conduit |
| 6 Cleaning Arms | 8 Suction Passageway |
| 10R Housing friction ridges | 10L Housing friction ridges |
| 12F Front sealing flange | 12B Back sealing flange |
| 14 Conduit receiving port | 16 Tool end of housing |
| 18 Conduit stop | 20 Arm pivot pegs (2 per arm) |
| 22 Bevel on end of arms | 24 arm channel |
| 26 Fiber picking edges | 28 Arm friction ridges |
| 30 Pivot holes (4 total) | 32 Guard tabs |
| 34 Arm stops | 35R Arm stop (Right) |
| 35L Arm stop (left) | 40 Nozzle housing (5-function) |
| 41 Upholstery surface | 42 Attachment recess |
| 43 Bristle retainer | 44 Dust brush |
| 45 Bristles | 46F Front sealing flange |
| 46B Back sealing flange | 47 Retainer gripping handle |
| 48R Range of motion (Right arm) | 48L Range of motion (Left arm) |
| 50 Second conduit port | 52 First conduit port |
| 54 Third port (tool end) | 55 tabs |
| 56 Tabs | 57 Flexible skirt |
| 58 Contact line | 60 Contact edge |
| 62 Lip | 64 Holes |
| 68 Port 50 axis line | 70 Port 52 axis line |
| 72 Arm stops | 74 Friction ridges |
| 80 Floor brush housing | 82 bristles |
| 84 Air Channel | 86 Connecting tube |
| 88 Attachment ring | 90 Alternate housing |
| 92 Bristles | 94 Cleaning arm |
| 96 Arm stop | 98 Arm stop |
| 100 Arm pegs | 102 Friction ridges |
| 104 Indentation | 106 Tabs |
| 108 Arm wing | 110 Air channel |
| 112R Friction ridges | 112L Friction ridges |
| 114F Front flange | 114B Back flange |
| 116 Lip | 118 Dust brush port |
| 120 Upholster/crevice port | 122 Center axis for port 118 |
| 124 Center axis for port 120 | 126 Brush attachment skirt |
| 128 Conduit stop | 132 Peg holes |
| 134 Extension | 136 Hub |
| 138R Right tongue | 138L Left tongue |

DETAILED DESCRIPTION OF THE PREFERRED EMBODIMENTS

The description presented here is organized in a logical manner. The discussion will start with the four-function vacuum cleaner nozzle. Then we will move on to the five-function nozzle, which incorporates the four-function nozzle into its design, and finally, we will present an alternative housing and arm design for the five-function nozzle.

Four-Function Nozzle

FIGS. 1 to 4

Figure 1:
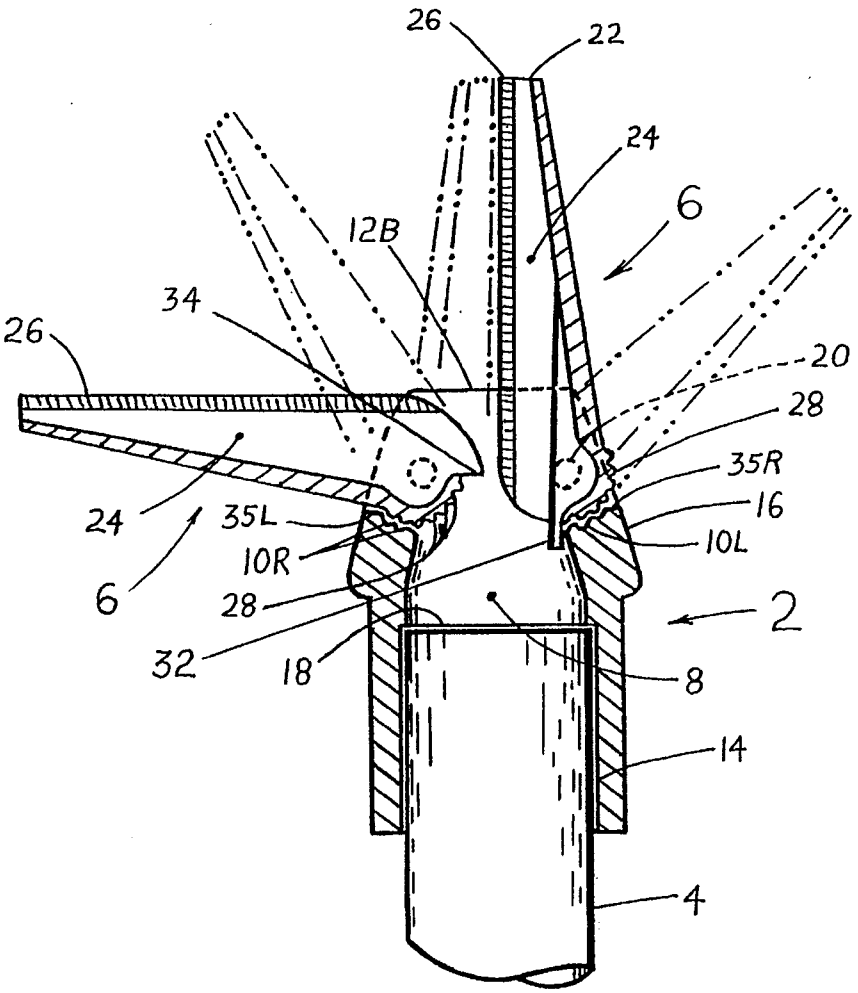

FIG. 1 shows a section view of a four-function vacuum cleaner nozzle in corner tool configuration. Phantom lines show several other positions for cleaning arms 6. The vacuum nozzle consists of three main parts: a nozzle housing 2, and a right and left cleaning arms 6.

Nozzle housing 2 is designed with a conduit receiving port 14, and a tool end 16. Receiving port 14 consists of a cylindrical tube designed to be attached on a suction conduit 4. The suction conduit is a suction communicating device such as a vacuum cleaner hose. The tool end is fashioned for mounting of two pivotal cleaning arms 6. A pair of friction ridges 10R and 10L interact with friction ridges 28 to provide many stable positions for the arms. Also on the tool end of housing 2 are a pair of sealing flanges 12F(front flange, not shown) and 12B(back flange). These flanges seal in vacuum air from escaping between the two arms. Conduit stop 18 prevents conduit 4 from being inserted too far into housing 2. Thus, stop 18 prevents conduit 4 from binding with arms 6.

Figure 2:
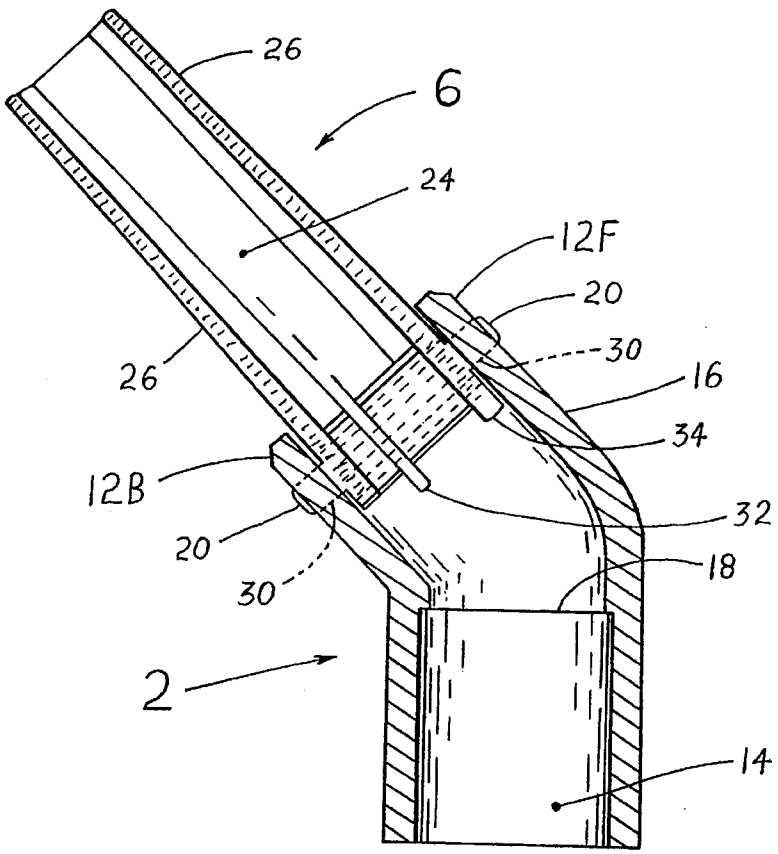

FIG. 2 shows the angled nature of housing 2. This angle is optional, but an angle around 45 degrees makes it easier to properly place the tool on most items to be cleaned. Pivot holes 30 are formed in the base of flanges 12F and 12B. Two pair (4 total) of these pivot holes provide a rotatable connection for pivot pegs 20 which protrude from each side of arms 6.

FIG. 2 shows arms 6 attached to housing 2. The left and right arms are identically constructed. This allows for easier manufacturing since only one mold is needed. Both arms are installed in housing 2 with channels 24 facing each other. The connecting of pegs 20 into holes 30 allow the arms to be rotated through an approximately 90 degree arc. The arms are made from any moldable material. A hard plastic works very well, though other materials could easily be used. Tab 32 and stop 34 protrude from the base of each arm. These protrusions help keep soft fabric material, such as drapes, from being sucked down suction passageway 8 when cleaning in upholstery tool configuration (FIG. 3).

As seen in FIG. 2, tab 32 and arm stop 34 are purposely positioned asymmetrically. The staggered positioning allows them to mesh when rotated. This prevents binding, and prevents such things as curtains from being sucked into the housing. Each arm has a "U" shape to it when looking down its length, forming a tapered channel with open ends. This shape forms channels 24 in which suction air may flow.

Figure 3:
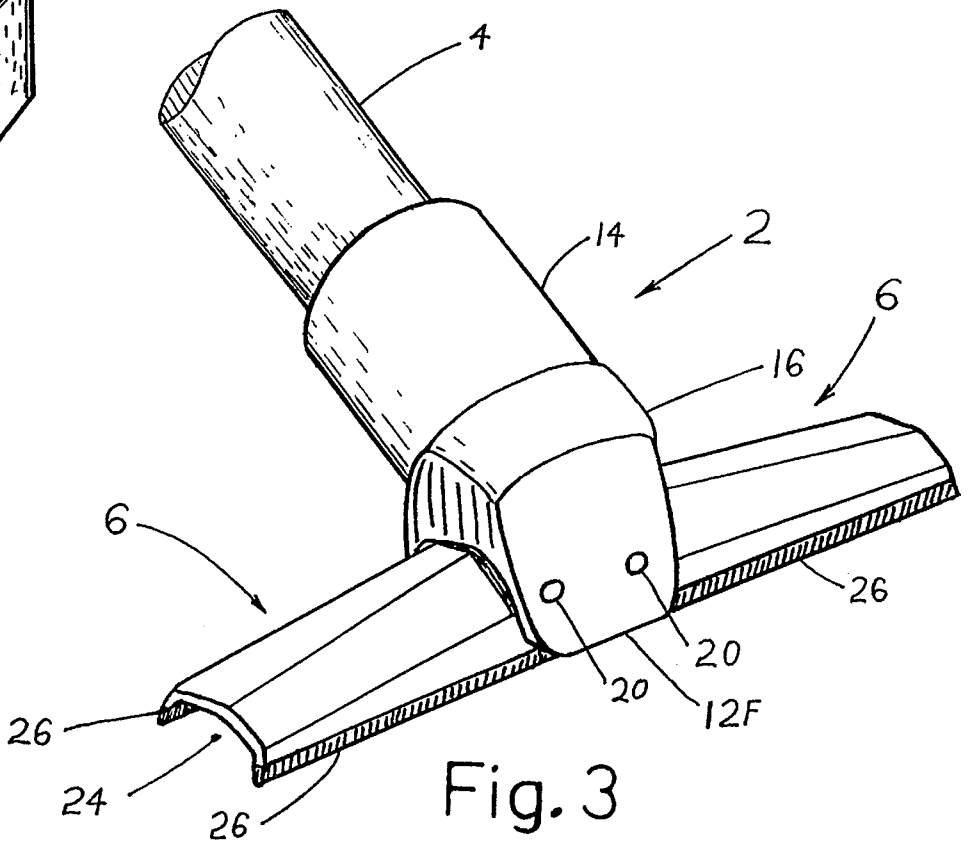

In FIG. 3 we see a perspective view of the four-function tool with the arms extended horizontally to be used as an edge or upholstery tool. Arms 6 are positioned to the sides forming a flat working surface for the fiber picking edges 26. These edges are designed to enhance the effectiveness of the nozzle. The fiber picking edges may be designed in several ways. For example, the edges could be coated with a resilient material such as rubber. This rubbery edge helps pull stubborn fibers away from fabrics so they may be sucked away more easily. Other possible edge would be a short whisker brush, or just a textured plastic surface. Edges 26 would increase friction, and thus, help pull fibers into channel 24 to be sucked away.

Figure 4:
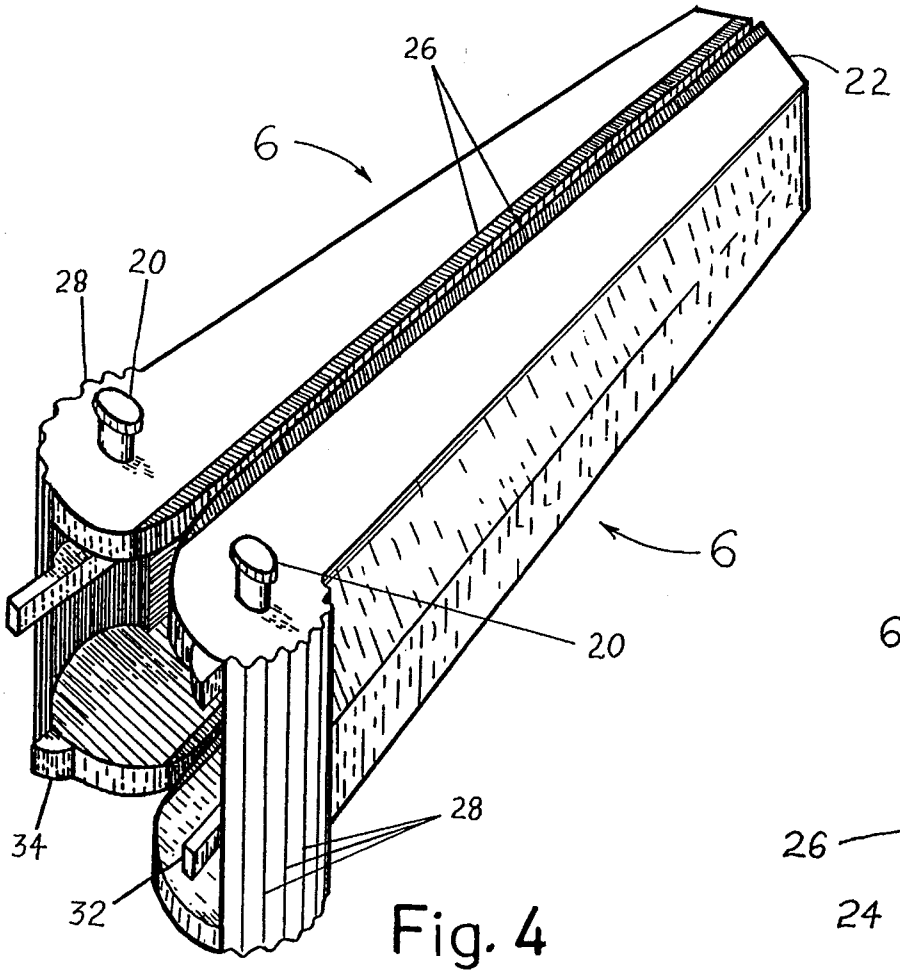

FIG. 4 shows arms 6 removed from the housing and in a united position where they are parallel to each other with the working surfaces opposed to each other. Pegs 20 protrude from the sides of each arm at its inner end. The positioning of the pegs is such that when installed in a housing edges 26 come together as shown. This allows the formation of a single enclosed passageway down the center of the two arms. On the inner portion of each arm is a stop 34 and a tab 32. Also on the inner end of the arms are friction ridges 28. These ridges are placed at a constant distance from the pivot pegs and extend around these pegs for approximately 90 degrees. The arms narrow toward the outer end, and end at beveled end 22.

Five-Function Nozzle

FIGS. 4 to 8

The five-function vacuum cleaner nozzle adds one more feature and one more part to the four-function nozzle, that is, a dust brush. The five-function nozzle consists of four main parts which are; a nozzle housing 40, a dust brush 44, and two cleaning arms 6. Notice the arms are identically to those used on the four-function nozzle. This five-function design is the most preferred configuration of the disclosed vacuum nozzle.

Figure 5A:
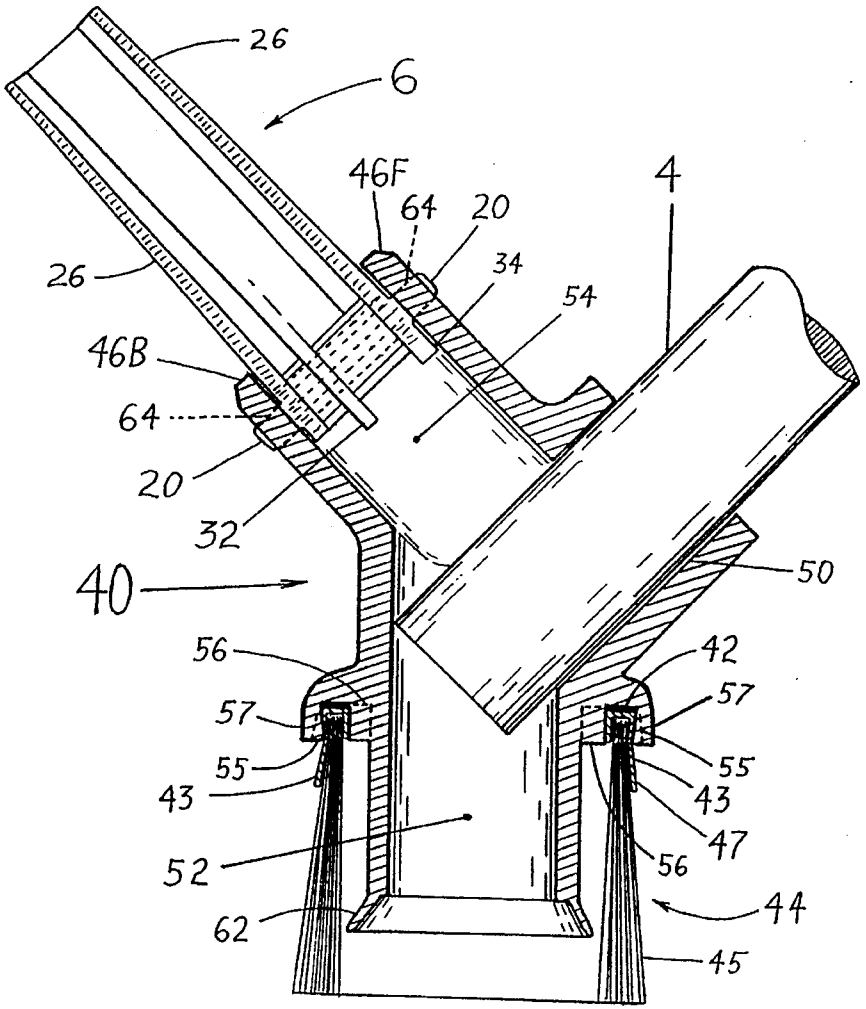

In FIG. 5A we see housing 40 in section. The housing has three ports labeled 50, 52, and 54. These three ports all intersect forming a connected suction passageway through the interior of housing 40. Ports 50 and 52 have the same diameter so they alternately accept suction conduit 4. Port 54 is basically the same structure as found on the four-function nozzle, with arm pegs 20 fitting into holes 64. Also on port 54 are front and back flanges 46F and 46B, which seal the junction area between the two arms, and thus form a continuous channel when in upholstery configuration. When conduit 4 is inserted into port 50, the end of conduit 4 seals against the inside wall of port 52 with an arc shaped contact line 58 (see FIG. 5B). This arrangement forms a tight seal so that port 54 is closed off from port 52.

Figure 5B:
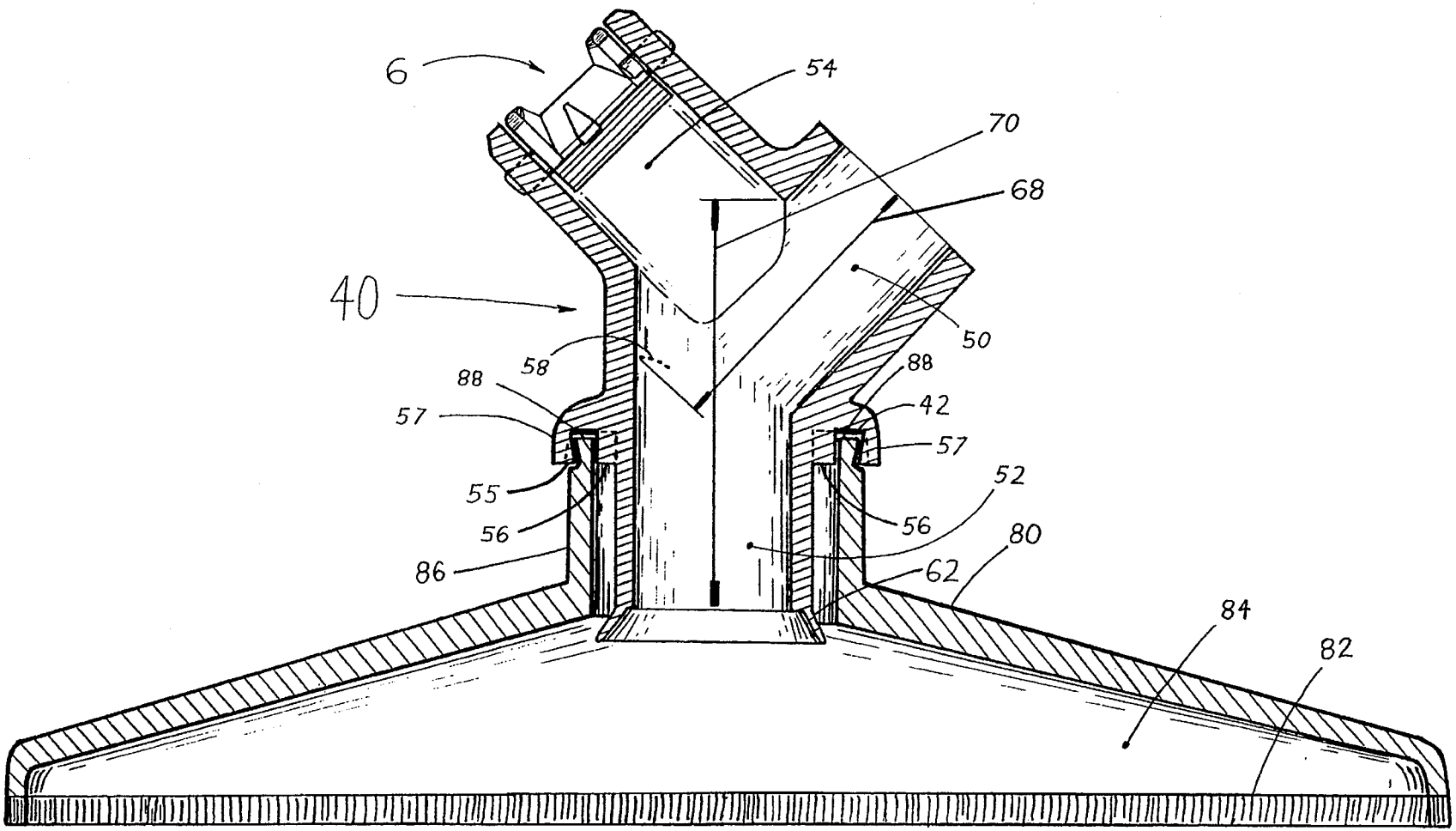

In FIG. 5B we see ports 50 and 52 both have a cylindrical shape. The intersection of these two ports is such that center axis 68 of port 50 intersects center axis 70 of port 52, but does not pass through port 52. Port 50 extends into port 52 only far enough for the outer edge of the cylinder inscribed by axis 68 to touch the back wall of port 52 at contact line 58. Notice line 58 is drawn above the projection line for axis 68. In actuality line 58 would follow this projection line, but for clarity it has been drawn the way it is so it is seen. All three ports 50, 52, and 54 are connected near the center of housing 40. Port 50 comes down from the right and port 52 straight up from below, while port 54 angles up to the left.

Figure 6:
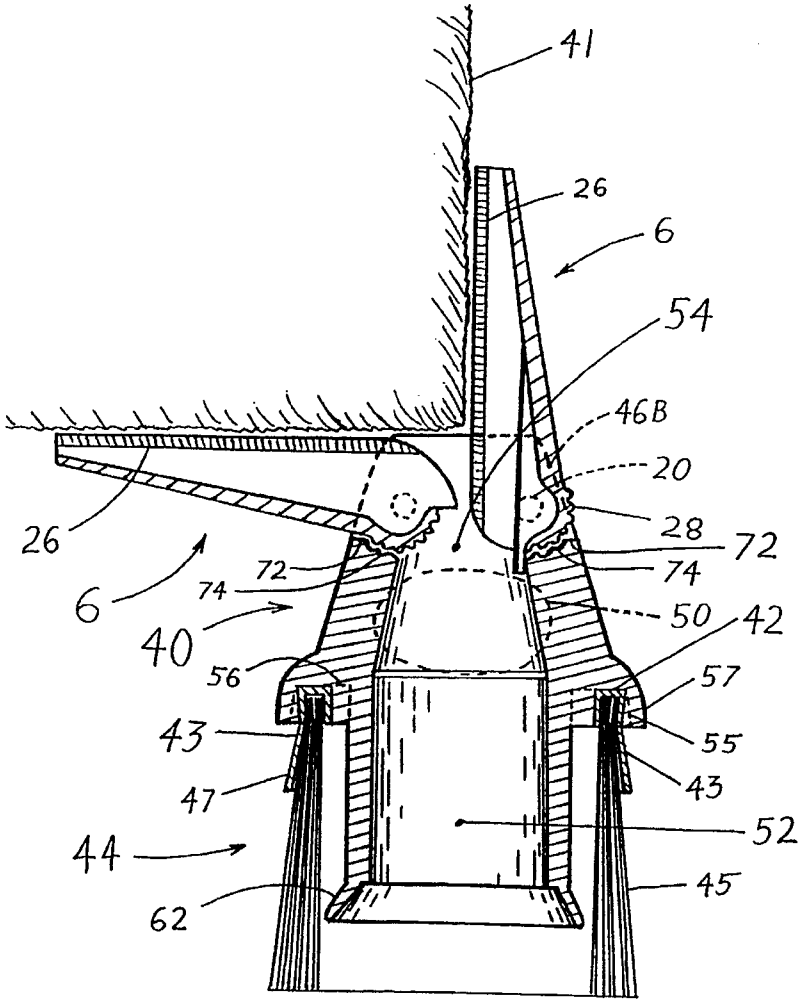

FIG. 6 shows a section view from the front of the five-function nozzle. The dashed line marked 50 shows the rim of port 50 as if it were not cut away for the section view. The housing is constructed as a single injection molded part, and must be pliable enough to allow friction ridges 28 and 74 to slip past each other, as well as, flexible enough to insert arms 6 between flanges 46F and 46B. Friction ridges 74 are defined on each side of housing 40 and interact with ridges 28 to provide several stable positions for arms 6. Stops 72 on each side of housing 40, limit the rotation of each arm, so the arms form a rigid upholstery tool when folded horizontal.

Figure 7:
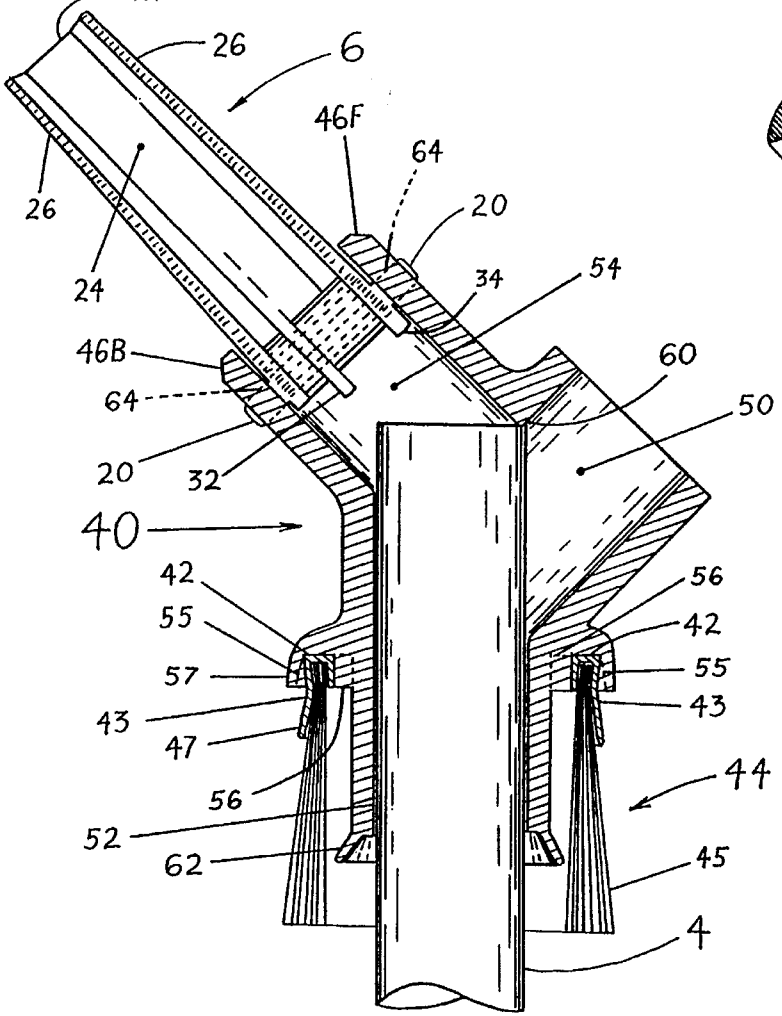

In FIG. 7 we see the same nozzle with the conduit inserted into port 52. The conduit seals against an arc shaped contact edge 60 on the inside extreme of port 50. The contact edge 60 matches the cylindrical shaped end of conduit 4, so port 50 is sealed off from the other two ports when the conduit is inserted. We also see, that holes 64 are placed far enough away from contact edge 60, so that tab 32 and stop 34 do not bind against conduit 4 when it is inserted into port 52 (as shown).

In FIG. 5A, dust brush 44 consists of bristles 45 which are held together by ring shaped retainer 43. The outside of retainer 43 is shaped to snap fit into attachment recess 42. The retainer extends down around the bristles to provide a gripping surface 47 for removing and installing the brush. Tabs 55 and tabs 56 are spaced around the inside of recess 42 to help dust brush 44 snap into place. With this design, different brushes may be attached (such as a floor brush, see FIG. 5B). The bristles surround the walls of port 52 and lip 62 help keep the bristles from jamming when suction conduit 4 is inserted into port 52 (FIG. 7).

Figure 8:
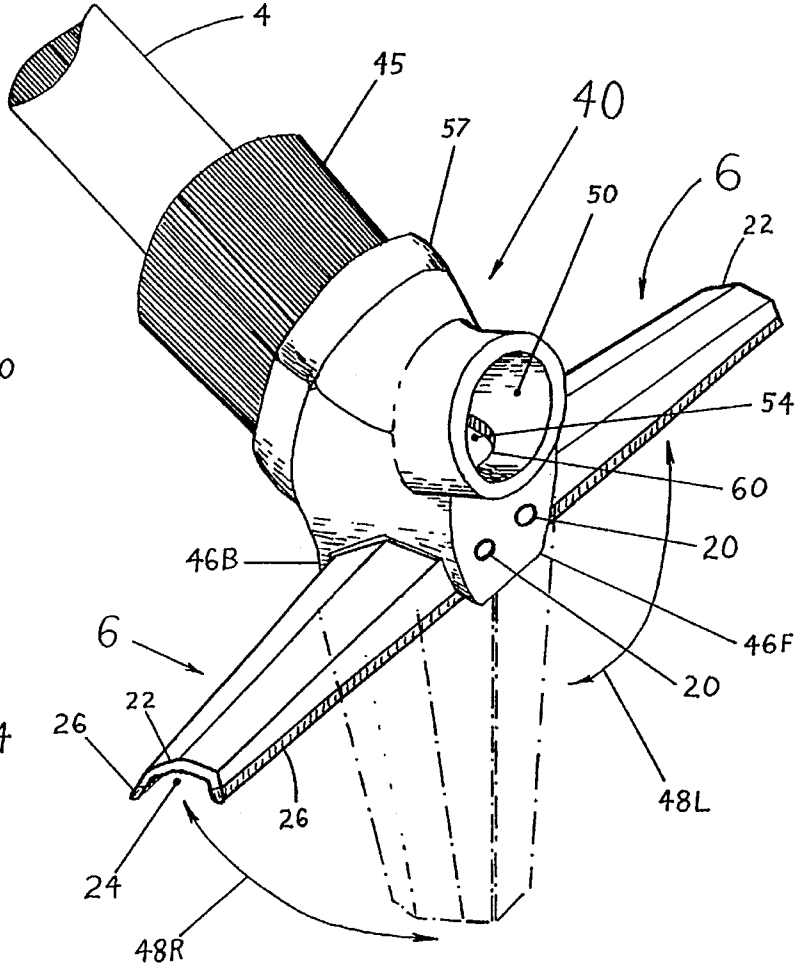

FIG. 8 shows a perspective view of the five-function tool in upholstery tool position. The outer end of each arm has a beveled end 22 to allow the nozzle to slide over fabric surfaces more easily when in crevice configuration (phantom lines). Notice how port 54 intersects the interior of port 50. This figure does not show suction conduit 4 fully inserted. If it were the end of the suction conduit would be touching contact edge 60.

Alternate Five-Function Nozzle

FIGS. 9A to 11

Figure 9A:
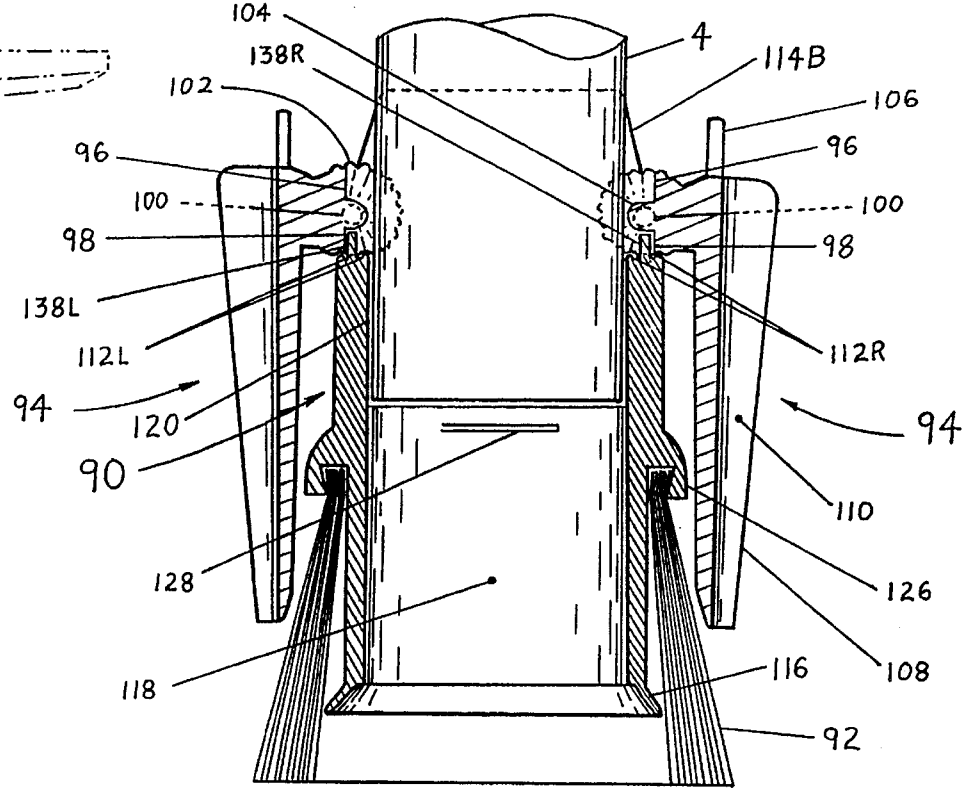

In FIG. 9A we see the alternate five-function vacuum cleaner nozzle in section. This nozzle consists of four main parts; a housing 90, a bristles 92, and a pair of cleaning arms 94. For simplicity we show bristles 92 molded into housing 90 at attachment skirt 126. This configuration makes the nozzle housing narrower, because there are no attachment brackets. This in turn allows arms 94 to rest closer to housing 90 when they are folded back to accept a suction conduit 4. The bristles could be attached in any number of ways, including, gluing, pressure fit, or snap fit as seen on the five-function nozzle. The bristle fibers may be natural or synthetic, and are stiff enough to effectively agitate dust from surfaces, stiffness depending on preference.

Figure 9B:
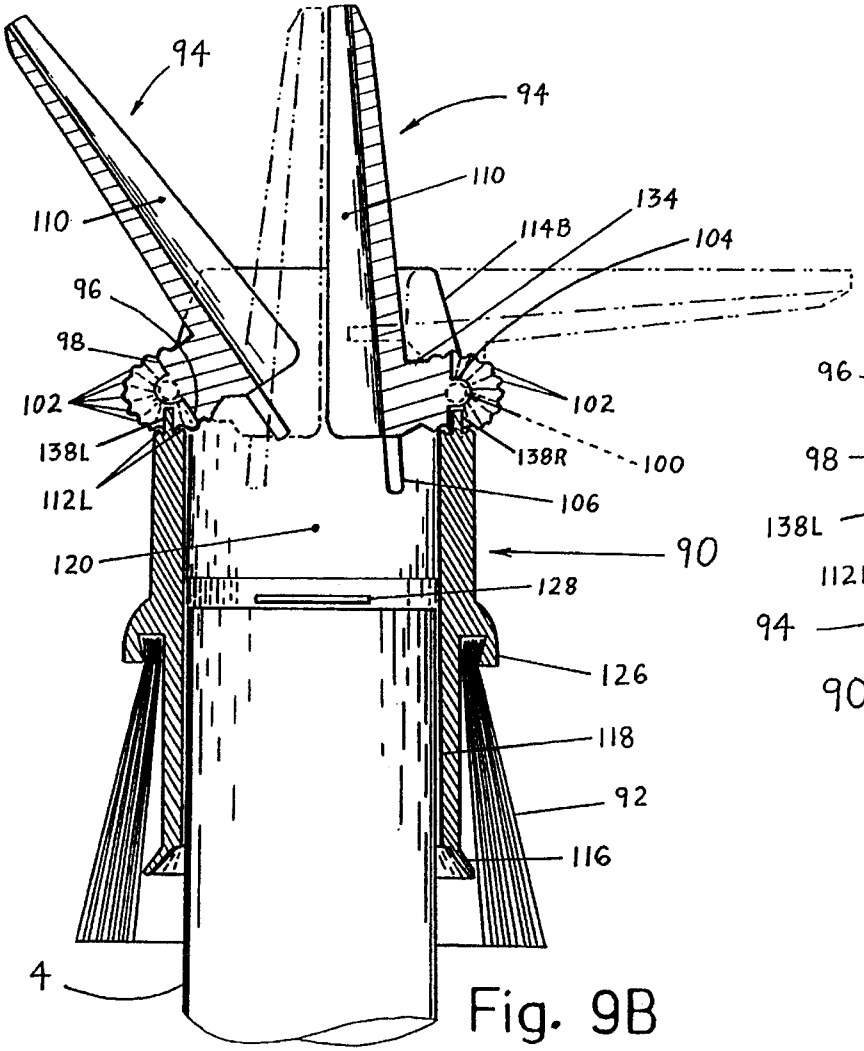

In FIG. 9B we see the alternate nozzle in section. Arms 94, and bristles 92 are attached to housing 90. The housing is cylindrical shaped with an air passage through its center. Ports 118 and 120, both accept a suction conduit and connect the two ends of the nozzle. On the brush side of the nozzle, lip 116 forms a soft ring shaped end of the housing. This lip helps keep brush bristles out of port 118 and also helps guide a suction conduit into port 118.

Figure 10:
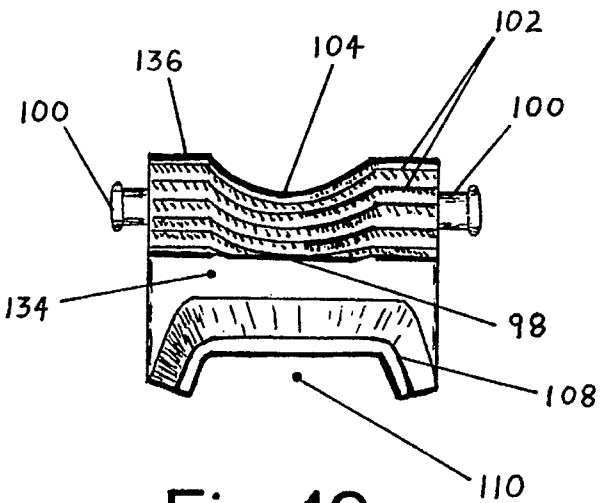

FIG. 10 shows a perspective view of alternate cleaning arm 94. Each arm has a pair of round pegs 100 at each end of cylindrical hub 136. Arms 94 are roughly "L" shaped (see FIG. 9A) when viewed from the side. With extension 134 and hub 136 forming the bottom portion of the "L" shape, and arm wing 108 forming the remainder. Arm wing 108 also defines an air channel 110 which extends the length of the arm. And friction ridges 102 are formed on hub 136 and follow the contour of indentation 104.

Figure 11:
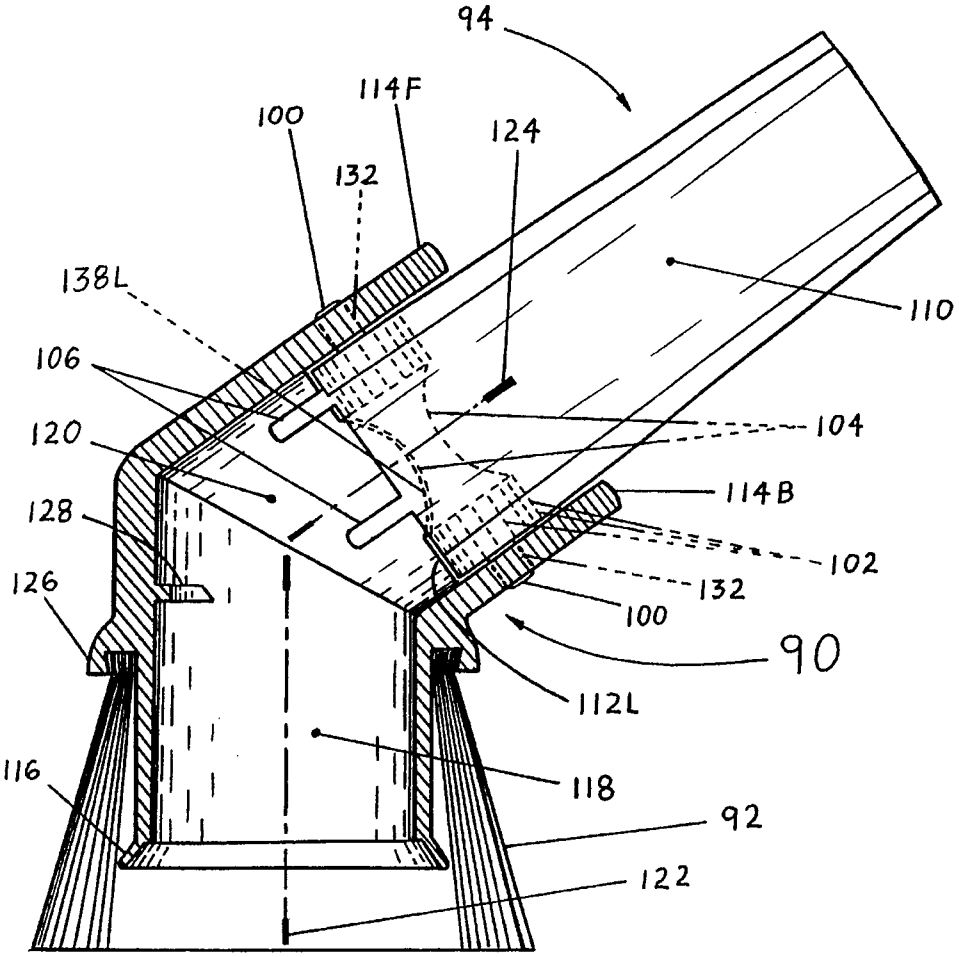

In FIG. 11 we see housing 90 has two ports 118 and 120 with center-of-axis lines 122 and 124 respectively. The two ports form a junction with an angle approximately 45 degrees off from parallel. Stop 128 is molded into the interior wall of port 118. This protrusion prevents over insertion of a suction conduit into port 118 so that the suction conduit does not bind against arms 94.

At port 120 the housing is designed to accept two cleaning arms 94. Holes 132 are formed in pairs at the base of flanges 114F and 114B. These hole pairs accept pegs 100 on the arms. The flanges extend above the holes and provide an air seal for the arms when they are in upholstery configuration. The flanges are made to rest flush against the sides of arms 94. At the base of flanges 114F and 114B and along the sides between them are a series of friction ridges 112R (see FIG. 9A) and 112L. In FIG. 11 we see the ridges are shaped to follow the contour of friction ridges 102 on arm 94. Tongues 138R (see FIG. 9B) and 138L in the center of ridges 112R and 112L seal air from escaping and also provide the surface for stop 96 and stop 98 interact with.

OPERATIONAL DESCRIPTION

Since there is a slight difference in operation between the different embodiments presented in this paper, we will present each embodiment separately. We will start with the four-function nozzle, then move on to the five-function nozzle, and finally finish with the alternate five-function nozzle.

Four-Function Nozzle

FIGS. 1, 3, and 6

FIG. 1 shows a section view of the four-function nozzle with cleaning arms 6 in position to be used as a crevice tool. A suction conduit 4 is inserted into a receiving port 14 of housing 2 until it reaches stop 18. Suction air is then communicated through passageway 8 to the cleaning arms. If arm 6 on the left is rotated vertically like arm 6 on the right, then channel 24 on each arm unite to form a single air passageway which focuses suction air to beveled end 22. The small width of end 22 allows the tool to get into small cracks and crevices to remove dirt and dust. To change the mode of operation the arms are moved to any of several positions. Two of the many possible positions are shown in phantom lines in FIG. 1. Stop 34 prevents each arm from rotating passed a vertical (crevice mode) position. Stops 35R and 35L are the counter stops for stop 34, and prevent the arms from rotating passed an in-line (upholstery mode) position.

FIG. 3 shows both arms folded to the side so that channel 24 on each arm form one long continuous channel. This arrangement produces a nozzle that will function as an upholstery tool. Fiber picking edges 26 of each arm are rubbed back and forth across a surface. The sticking nature of the edges tend to ball up hair and fibers so they are more easily vacuumed away. Suction air moving down channel 24 sweep away any such fibers and removes them from the nozzle through conduit 4. FIG. 3 also shows the configuration for an edge cleaner. The open end of each arm provides a powerful suction force from channel 24 which easily pulls dust and dirt away from edges. The nozzle arm is simply moved along a surface with the end of one arm against the edge to be cleaned, vacuum air does the rest.

FIG. 6 shows the five-function nozzle, however, the four-function nozzle in corner configuration operates in substantially the same way. In FIG. 6, arms 6 are be positioned to clean a curved edge; in this case, a right angled corner. By angling one arm vertically, and the other horizontally, a 90 degree angle is formed. Air channel 24 of each arm conducts suction air to the end of each arm, creating a fast moving stream of air across upholstery surface 41. Thus, when the nozzle is rubbed back and forth across surface 41, edges 26 help loosen fibers.

Five-Function Nozzle

FIGS. 5A TO 8

Lets first look at the dust brush operation. In FIG. 5A we see a section view of the five-function nozzle. Suction conduit 4 is inserted into port 50 so that vacuum suction is communicated to port 52 (dust brush). Because of the cylindrical shape of port 52, the front edge of conduit 4 nearly matches the arcing inner surface of port 52. This means that a nearly perfect seal is made between port 52 and conduit 4 at contact line 58. In tests, with housing 40 made from a slightly pliable material, a good seal was accomplished without any modifications to the inner wall of port 52.

With the suction conduit inserted as shown in FIG. 5A, the dust brush is ready for use. Cleaning arms 6 may be placed in any position while using the dust brush, however, our preference is with the arms in crevice tool position as shown in this figure. Dusting is accomplished by moving the brush back and forth across the surface to be cleaned. Dust and dirt is then sucked up into port 52 and away through conduit 4. To change tools on port 52, one grips handle portion 47 of retainer 43 and pulls the dust brush off of housing 40. Then a new tool is installed.

FIG. 5B shows how the dust brush is detachable and how a floor brush, or other tool, is snap fit into recess 42. The changing of tools is simply a matter of pulling one tool off and snapping the other in place. An attachment ring 88 on floor brush housing 80 snaps into place between tabs 56 and skirt 57. Connecting tube 86 extends brush housing 80 passed lip 62 to provide unobstructed air flow. For operation, a suction conduit would be inserted into port 50 to communicate suction to floor brush housing 80. Suction air is distributed to bristles 82 through channel 84. Agitating bristles 82 back and forth across a hard floor surface knocks dirt and debris loose, which is sucked away. Note in FIG. 5B that floor brush housing 80 is installed 90 degrees off of its normal operating orientation. For ease of use, the long axis of housing 80 should be perpendicular to axis 68 of port 50.

Now lets look at the other end of the five-function nozzle where arms 6 are attached. FIG. 7 shows the five-function nozzle with suction conduit 4 inserted into port 52. In this position, conduit 4 communicates vacuum suction to port 54 (and ultimately to arms 6). Port 50 is closed off in this configuration, with conduit 4 sealing against contact edge 60.

In FIG. 8 we see arms 6 are pivotal through 90 degrees between a position where edges 26 form a flat surface for cleaning upholstery, and a position where the arms come together in a substantially united position (see phantom lines) to form a crevice tool. Each arm may be moved independently and adjusted to any intermediate position to form an angled tool for cleaning such curved surfaces as stair corners. In upholstery configuration as shown in FIG. 8 the arms form a flat channel which is open at each end. When the arms are place down on a surface to be cleaned, air is sucked in through the ends of the arms. Thus, a fast moving passageway of air sucks dust and dirt away toward the center of the arms and up into port 54 and then way through conduit 4.

FIG. 6 shows one possible configuration. In this drawing arms 6 forming a 90 degree angle for cleaning a corner. Channels 24 form two air passageways when arms 6 is placed against a right angled surface 41. Air then flows down channel 24 of each arm as arms 6 move along the surface. This air flow sucks dust and dirt away as the nozzle is moved back and forth across surface 41. Edges 26 help dislodge foreign material so that it may be vacuumed away.

FIG. 7 and 8 show arms 6 in crevice tool position, (phantom lines in FIG. 8). In this position the two arms act as one. Force exerted on the side of either arm does not shift the crevice tool configuration. This is because stop 34 on each arm prevent the arms from going pass their forward facing position. Vacuum suction also helps hold the two arms together. Thus, the only way to separate the arms is to pull them apart. When the nozzle is being used as a crevice tool, it is sometimes slid back and forth sideways across a surface. With this type of motion there is the possibility that the trailing arm could catch on the surface and be pulled away from the other arm. To help prevent this, the end of each arm is beveled (end 22). Beveled end 22 help reduce friction as the tool is slid sideways across a surface, thus reducing the chances arms 6 will catch on the cleaning surface and be pulled apart. FIG. 8 also shows the configuration for an edge cleaner. The open end of each arm provides a powerful suction force from channel 24 when placed against a surface. The nozzle arm is simply moved along a surface with the end of one arm against the edge to be cleaned, vacuum air does the rest.

Alternate Five-Function Nozzle

FIGS. 9 TO 11

FIG. 9A shows the alternate L nozzle in section. Port 118 and port 120 are fashioned to accept a suction conduit. Conduit 4 is shown inserted into port 120. Arms 94 are rotated down and to the sides of housing 90. Indentation 104 (see FIG. ! 0) allows conduit 4 to slide passed the arms. Once conduit 4 is positioned as shown in FIG. 9A suction air is communicated to port 118 and then to bristles 92. With suction air flowing to bristles 92, cleaning is accomplished by sliding bristles 92 across a surface. This action agitates dust and dirt, which is then sucked up into port 118 and away through conduit 4. Lip 116 helps keep the bristle from getting pulled inside port 118.

FIG. 9B shows the same view as FIG. 9A, but with suction conduit 4 inserted into port 118 and the arms in different working positions. Stop 128 restricts the depth to which conduit 4 is insertion. This prevents the end of conduit 4 from binding with tabs 106 on arms 94. Once the conduit is inserted suction air is communicated to port 120 and then to arms 94.

FIG. 9B shows a few positions of arms 94 in phantom lines. By positioning arms 94 in different position they have different functions. With the arms forward facing (pointing up in FIG. 9B) the nozzle acts as a crevice tool. When the arms are horizontal (pointing away from each other) they function as an upholstery tool. In upholstery configuration the open ends of arms 94 act like small crevice tools, perfect for cleaning edges. And by adjusting the arms to intermediate positions, one may clean curved surface or corners.

In upholstery configuration, arms 94 are horizontal. A single long air channel is formed by placing channel 110 of each arm in line with each other. Flanges 114F (shown in FIG. 11) and 114B seal suction air within channels 110 by closing off the open space between arms 94. When cleaning very flexible surfaces, such as drapes, tab 106 on each arm keep the drapes from being sucked into conduit 4.

In FIG. 9B with both arms facing upward as the right arm, a crevice tool is formed. Suction air is conducted through port 120 and out through the air passage created by joining air channels 110 from each arm. Stop 96 prevents the arms from rotating passed the vertical position. By limiting the rotation the crevice tool formed by arms 94 is stable, and resists side forces.

FIG. 10 shows a perspective view of the alternate arm 94. The most notable difference between this arm and the arm used on the other nozzle housings is an indentation 104 in the center of friction ridges 102. This indentation allows conduit 4 to be inserted when arms 94 are rotated backward flush against housing 90 (see FIG. 9A). Extension 134 is also added to increase the reach of wing 108. Without this extension, arms 94 would be too far apart for wings 108 to form a crevice tool.

FIG. 11 shows a side view of the alternate nozzle in section. This design has the same angled passage as the five-function tool, but only has two ports. The elimination of the extra port is accomplished by redesigning the arms so that a suction conduit can be installed in port 120. Indentation 104 allow the rotation axis of arms 94 to be placed closer to each other. This reduces the length of extension 134 and flanges 114F and 114B. Indentation 104 also helps reduce the overall width of housing and thus makes a smaller nozzle.

NOVEL FEATURES

The invention has many novel features, the most notable being that it functions as five-tools-in-one. Even more amazing is that two of the functions (corner and edge tool configuration) were created by accident when making a three-function tool. The arm design allowed these two added function by simply adjusting the arms. This was all accomplished without any added parts compared to Fahlen's 2-function nozzle.

The arm assembly itself is novel, because it allows so many tools to be incorporated into a single unit (Crevice, Edge, Corner, and Upholstery tools). The arm design requires only three parts: a Tool Housing, and a Left and Right Arm. By pivoting of the arms into different positions one can convert between functions. The open ended channel defined on each arm is also novel and without which a crevice tool could not be formed.

Finally, the three-port tool housing design is novel. The ability to use the vacuum hose conduit to seal off unwanted ports is critical to the design. The double-inlet double-outlet three-port design, is both new and unusual. It allows two separate tool assemblies to receive air from two separate air ports, while only having a total of three ports.

SUMMARY, RAMIFICATIONS, and SCOPE

Although the above description of the invention contains many specifications, these should not be viewed as limiting the scope of the invention. Instead, the above description should be considered illustrations of some of the presently preferred embodiments of this invention. For example, the seal flanges on the tool housings, could be eliminated all together by redesigning the arms so that they mesh. Also, the length of the arms is a matter of preference, being easily made longer or shorter.

Many other minor changes in the invention could be made, such as, changing the shape of the tool housing, the shape of the arms, the position and angle of the ports, the shape and length of the brush, the friction method on the arms, and etc. Furthermore, brush 44 and recess 42 need not be round, but could be made to whatever shape desired. Alternative ways to attach bristles 45 would include molding them directly into the housing, gluing them into recess 42, or etc. Likewise, stop 128 for the alternate nozzle, is not needed if port 120 was made longer.

The arm designs may also be changed. Arms 94 on the alternate nozzle in FIG. 9B could easily be redesigned so that channel 110 is wider and deeper near its inner end (where attached to housing). Air channel 110 on each arm would then be much larger, and this added space would allow easy entry of a suction conduit into port 120. The arms would only need to be separated a small angle from the crevice tool position for suction conduit 4 to be inserted. This would eliminate the need for the arms to rotate passed and in-line (upholstery configuration) and thus make a more stable upholstery tool.

Finally, the housings could also be changed. If made from a hard plastic, slots could be cut into the sealing flanges, which would lead to the peg holes. This would allow the arms to be snapped in place even though the housing does not have much resiliency. Or one could just replace the peg holes with dimples that receive a nipple formed on the arms. The arms would then be snapped into place.

Thus, the scope of this invention should not be limited to the above examples, but should be determined from the following claims.

We claim:

1. A vacuum cleaner nozzle, comprising:

(a) a housing provided with a suction passageway extending therethrough, said housing having a tool end and a conduit receiving port positioned on opposite ends of said suction passageway, said conduit receiving port being adapted to receive a suction conduit, whereby vacuum suction air is communicated from said suction conduit to said tool end;

(b) a pair of cleaning arms each defining an elongated air channel with open ends and having an inner and outer end; and (c) a pivotable mounting means for pivotally connecting said inner ends of the arms to said tool end.

2. The vacuum cleaner nozzle in claim 1, wherein:

said cleaning arms are mounted substantially adjacent to one another on said tool end and said air channels are opposed to each other when said cleaning arms are rotated to be parallel to each other.

3. The vacuum cleaner nozzle in claim 2, wherein:

said tool end is adapted to accept said suction conduit and communicating with said suction passageway; and said cleaning arms each being pivotable to a plurality of positions including a substantially united position for communicating suction air from said suction passageway to said outer end of said arms, and a substantially inoperative position for allowing attachment of said suction conduit to the tool end of said suction passageway.

4. The vacuum cleaner nozzle in claim 3 further including:

plurality of fiber picking edges defined on said cleaning arms, whereby a brushing action of the fiber picking edges across a surface help pull contaminants from the surface.

5. The vacuum cleaner nozzle in claim 1 further including:

a second conduit receiving port defined on said housing and substantially interconnected with said suction passageway, each conduit receiving port being capable of alternately having attached thereto said suction conduit;

an interchangeable tool; and an attachment means for securing said interchangeable tool to said housing, said interchangeable tool substantially surrounding the first conduit receiving port, whereby insertion of said suction conduit into said second conduit receiving port communicates vacuum air to said interchangeable tool.

6. The nozzle cleaner nozzle in claim 5, wherein:

said cleaning arms are mounted substantially adjacent to one another on said tool end and said air channels facing inwardly toward each other.

7. A vacuum cleaner nozzle, comprising:

(a) a housing having a tool end and first and second ports with a suction passageway therethrough interconnecting said first and second ports with said tool end, both ports being adapted to receive a suction conduit and each receiving port being capable of alternately having attached thereto said suction conduit;

(b) a pair of cleaning arms each describing an air channel with open ends, said channels formed in the direction of elongation of said cleaning arms;

(c) an interchangeable tool substantially surrounding said first port;

(d) a pivotable mounting means for connecting one end of cacti arm to said tool end of said housing; and (e) a securing means which allows attachment and removal of said interchangeable tool to said housing.

8. The vacuum cleaner nozzle in claim 7, wherein:

said cleaning arms are mounted substantially adjacent to one another on said tool end and said air channels are opposed to each other.

9. The vacuum cleaner nozzle in claim 8, wherein:

a plurality of fiber picking edges are defined on said cleaning arms, whereby a brushing action of the fiber picking edges across a surface help pull contaminants from the surface.

10. The vacuum cleaner nozzle in claim 7, wherein:

said second port intersects said first port diagonally, said suction passageway substantially connecting said suction conduit to said tool end when said suction conduit is inserted into said first port, and said suction passageway substantially connecting said suction conduit to said first port when said suction conduit is inserted into said second port.

11. The vacuum cleaner nozzle in claim 10, wherein:

said cleaning arms are mounted substantially adjacent to one another on said tool end and said air channels are opposed to each other.

12. A plural function nozzle for a vacuum cleaner, comprising:

(a) a housing having a suction passageway extending therethrough, both ends of said suction passageway being capable of alternate attachment to a suction conduit;

(b) a pair of cleaning arms each describing an elongated air channel having open ends, each arm having inner and outer ends;

(c) a dust brush secured to said housing and substantially surrounding one end of said suction passageway;

(d) a pivotable securing means for attaching said inner end of each arm to said passageway opposite said dust brush, said cleaning arms being mounted substantially adjacent to each other and pivotable in opposite directions, whereby said elongated air channels rotate together to form a single air passageway.

13. The vacuum nozzle in claim 12, wherein:

said cleaning arms each being pivotable to a plurality of positions including a substantially united position forming a single air passageway for communicating suction air from said suction passageway to the outer end of said cleaning arms, and a substantially inoperative position allowing attachment of said suction conduit to the tool end of said suction passageway.

14. The vacuum nozzle in claim 13, wherein:

plurality of fiber picking edges are defined on said cleaning arms, whereby a brushing action of the fiber picking edges across a surface help pull contaminants from the surface.

15. A vacuum cleaner nozzle, comprising:

(a) a housing provided with a suction passageway extending therethrough, having a tool end and a conduit receiving port defined on opposite ends of said suction passageway, said conduit receiving port being adapted to receive a suction conduit;

(b) a pair of cleaning arms mounted substantially adjacent to each other on said tool end and pivotable in opposite directions to a plurality of cleaning positions, one of said positions being when said arms are rotated to be parallel, with the working surfaces of said arms being opposed to each other.

16. The vacuum cleaner nozzle in claim 15, further including:

an elongated air channel with open ends defined on each of said cleaning arms, with the rim of each air channel defining a plurality of fiber picking edges, whereby a brushing action of the fiber picking edges across a surface helps pull contaminants from the surface.

17. The vacuum cleaner nozzle in claim 15, further including:

second conduit receiving port defined on said housing, said second conduit receiving port placed between said tool end and the first conduit receiving port, each receiving port being capable of alternately having attached thereto said suction conduit;

an interchangeable tool; and an attachment means for securing said interchangeable tool to said housing, said interchangeable tool substantially surrounding the first conduit receiving port, whereby insertion of said suction conduit into said second conduit receiving port communicates vacuum air to said interchangeable tool.

18. The vacuum cleaner nozzle in claim 15, wherein:

said housing defines a second conduit receiving port at said tool end of said suction passageway, each receiving port being capable of alternately having attached thereto said suction conduit;

said cleaning arms each define an elongated channel with open ends; and said elongated channels mounted facing each other, whereby said elongated channels may be rotated to a united position forming a single substantially enclosed air passageway.

* * * * *

UNITED STATES PATENT AND TRADEMARK OFFICE

CERTIFICATE OF CORRECTION

PATENT NO. : 5,502,870

DATED : April 2, 1996

INVENTOR(S) : Gary D. Ragner & Robert deRochemont Jr.

It is certified that error appears in the above-identified patent and that said Letters Patent is hereby corrected as shown below:

Column 12, Line 22 "cacti" should read --each--.

Signed and Sealed this

Fourth Day of January, 2000

*Attest:*

*Attesting Officer*

*Acting Commissioner of Patents and Trademarks*